US007627258B2

(12) United States Patent
Okimura et al.

(10) Patent No.: US 7,627,258 B2
(45) Date of Patent: Dec. 1, 2009

(54) IMAGE FORMING APPARATUS AND IMAGE FORMING METHOD USING INITIAL TONER

(75) Inventors: Naomasa Okimura, Saitama (JP); Tsutomu Somemiya, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 251 days.

(21) Appl. No.: 11/694,212

(22) Filed: Mar. 30, 2007

(65) Prior Publication Data

US 2008/0085129 A1 Apr. 10, 2008

(30) Foreign Application Priority Data

Oct. 5, 2006 (JP) ..... 2006-273700

(51) Int. Cl.
*G03G 15/00* (2006.01)

(52) U.S. Cl. ..... 399/13; 399/24

(58) Field of Classification Search ..... 399/9, 399/12, 13, 24, 25, 27
See application file for complete search history.

(56) References Cited

U.S. PATENT DOCUMENTS

2006/0263107 A1* 11/2006 Inukai et al. ..... 399/27

FOREIGN PATENT DOCUMENTS

JP 2003-50495 * 2/2003
JP 2005-241868 A 9/2005

* cited by examiner

*Primary Examiner*—Hoan H Tran
(74) *Attorney, Agent, or Firm*—Sughrue Mion, PLLC

(57) ABSTRACT

An image forming apparatus includes an image forming apparatus main body; a development device that develops a latent image formed in an image retainer with toner; a toner cartridge that is detachably attached to the image forming apparatus main body and that contains toner supplied to the development device; and a controller that switches and controls a first print mode wherein printing is carried out in a state where the toner cartridge is not attached to the image forming apparatus main body and a second print mode wherein printing is carried out in a state where the toner cartridge is attached to the image forming apparatus main body.

15 Claims, 4 Drawing Sheets

PRINT MODE SELECTION PROCESSING S10

PRINT MODE SELECTION PROCESSING S10

IMAGE FORMING APPARATUS AND IMAGE FORMING METHOD USING INITIAL TONER

CROSS-REFERENCE TO RELATED APPLICATIONS

This application is based on and claims priority under 35 USC 119 from Japanese Patent Application No. 2006-273700 filed Oct. 5, 2006.

BACKGROUND

1. Technical Field

The present invention relates to an image forming apparatus such as a printer, a copier, a facsimile, and the like.

2. Related Art

As this sort of an image forming apparatus, a device equipped with a toner cartridge detachably attached to a development device is known.

A problem of a conventional image forming apparatus has been that the cost of a toner cartridge is added to the cost of the image forming apparatus main body since the toner cartridge is attached to or packed with the image forming apparatus main body beforehand at the shipment and thus the cost of the image forming apparatus is hardly reduced. As an image forming apparatus to cope with the problem, there is an image forming apparatus wherein a toner cartridge filled with a smaller amount of toner than an interchangeable toner cartridge is attached to or packed with the image forming apparatus main body. In such an image forming apparatus, the cost of the toner can be reduced but the cost of the toner cartridge main body is still incurred.

SUMMARY

The present invention provides an image forming apparatus that can address the above conventional problem, print a prescribed number of copies even when a toner cartridge is not attached to the image forming apparatus main body, and reduce the purchase price.

According to an aspect of the present invention to attain the foregoing, there is provided an image forming apparatus including: an image forming apparatus main body; a development device that develops a latent image formed in an image retainer with toner; a toner cartridge that is detachably attached to the image forming apparatus main body and contains toner supplied to the development device; and a first print mode wherein printing is carried out in a state where the toner cartridge is not attached to the image forming apparatus main body.

BRIEF DESCRIPTION OF THE DRAWINGS

Exemplary embodiments of the present invention will be described in detail on the basis of the following figures, wherein.

DETAILED DESCRIPTION

The first exemplary embodiment of the present invention is explained hereunder with reference to the drawings.

Figure 1:
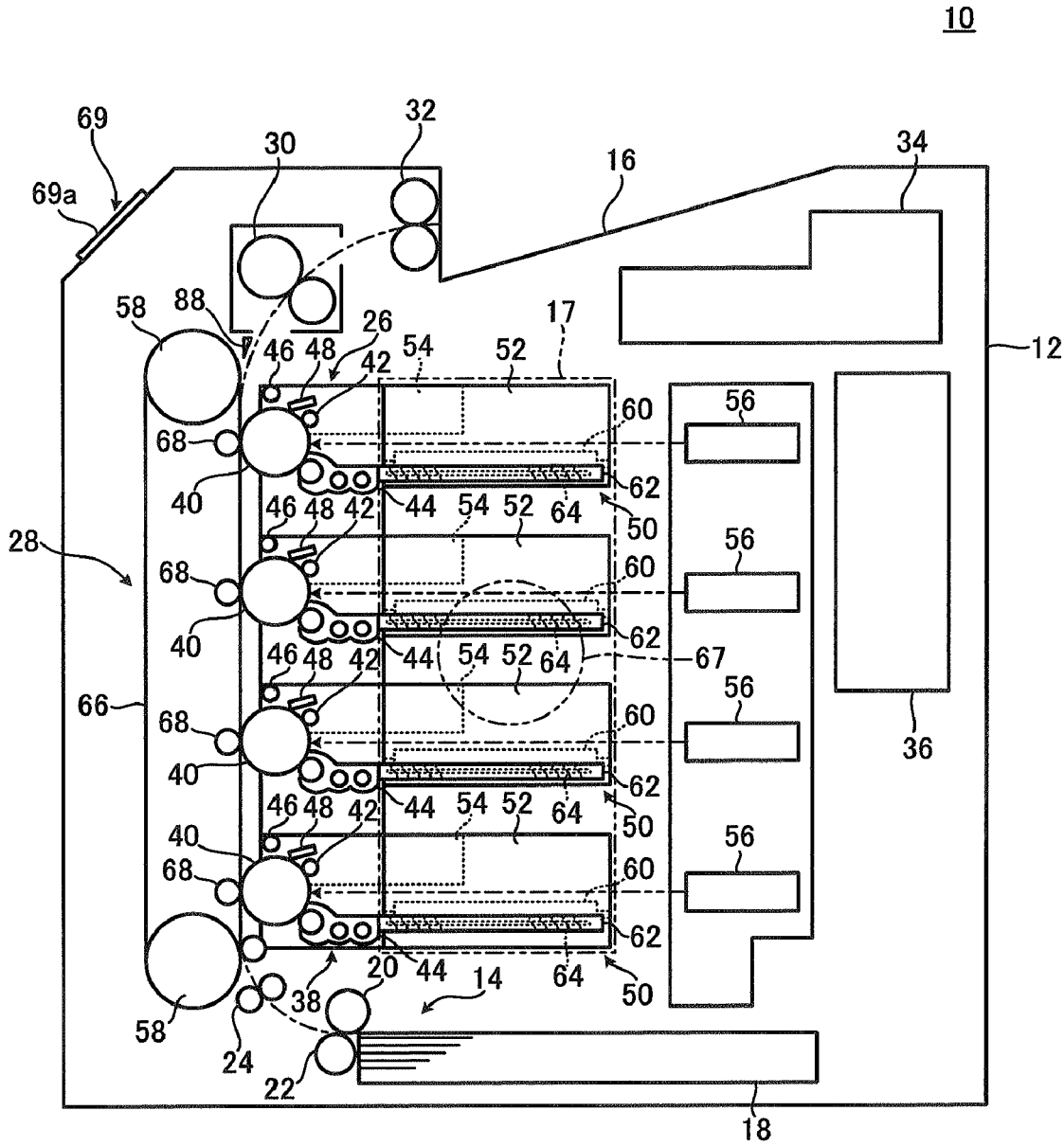
FIG. 1 is a side view showing an image forming apparatus according to an exemplary embodiment of the present invention.
Figure 2:
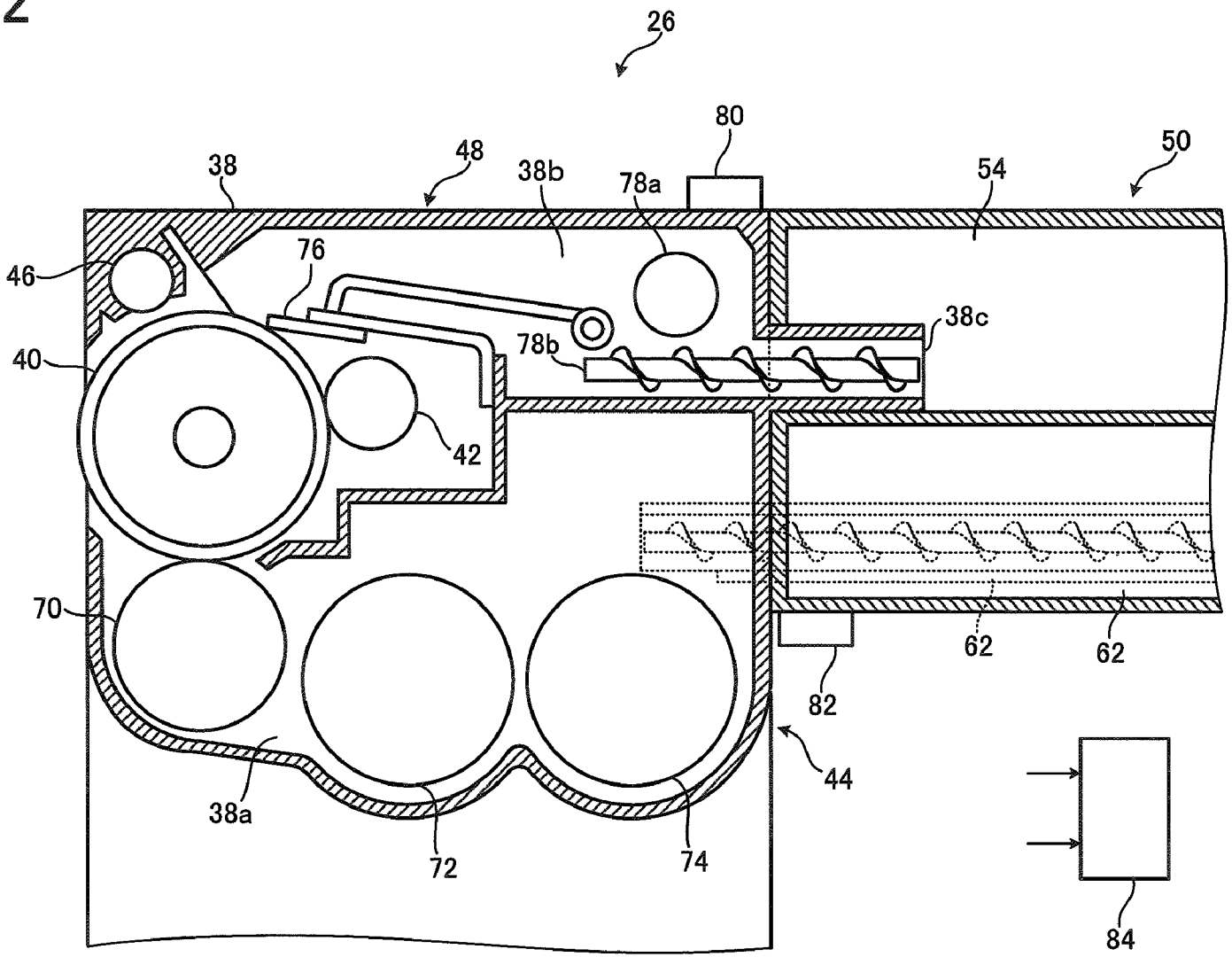
FIG. 2 is a vertical sectional view showing the vicinity of the photoreceptor unit of an image forming apparatus according to an exemplary embodiment of the present invention.

An image forming apparatus 10 according to the present exemplary embodiment of the present invention is shown in FIGS. 1 and 2. The image forming apparatus 10 is provided with an image forming apparatus main body 12, a sheet feeder 14 is disposed at the lower part of the image forming apparatus main body 12, and a sheet discharge section 16 is formed at the upper part of the image forming apparatus main body 12. Further, on a side (on this side in the figure) of the image forming apparatus main body 12, an opening and closing cover 17 is disposed on the image forming apparatus main body 12 in an openable and closable manner. The opening and closing cover 17 is placed at the position corresponding to toner cartridges 50 that are described later so that an opening may be formed and the toner cartridges 50 may be attached or detached through the opening when the opening and closing cover 17 is opened.

The sheet feeder 14 is provided with a sheet cassette 18 and many sheets are piled in the sheet cassette 18. A feed roller 20 is disposed on the upper side of one end of the sheet cassette 18 and a retard roller 22 is disposed opposite the feed roller 20. The uppermost sheet in the sheet cassette 18 is picked up with the feed roller 20, handled by the cooperation of the feed roller 20 and the retard roller 22, and conveyed.

A sheet conveyed from the sheet cassette 18 is stopped temporarily with resist rollers 24 and discharged to the sheet discharge section 16 with discharge rollers 32 at prescribed timing while passing between a photoreceptor unit 26 and a transfer unit 28 and through a fixing device 30, those being described later.

In the image forming apparatus main body 12, the photoreceptor unit 26, the transfer unit 28, an electric power unit 34, and a controller 36 are disposed. In the photoreceptor unit 26, for example, four photoreceptors 40 are rotatably supported with a photoreceptor unit main body 38. Around each of the photoreceptors 40, an electrifier 42 as an electrifying unit provided with an electrification roller to uniformly electrify the photoreceptor 40, a development device 44 as a development device to develop a latent image written into the photoreceptor 40 with a developer (toner), a static eliminator 46 to statically neutralize the photoreceptor 40 after subjected transfer, and a cleaner 48 to remove toner remaining on the photoreceptor 40 after the transfer are disposed. The photoreceptor unit 26 is formed by integrating four sets each of which includes a photoreceptor 40, an electrifier 42, a development device 44, a static eliminator 46, and a cleaner 48.

The electric power unit 34 is disposed at the upper part in the image forming apparatus main body 12 and designed so as to supply electric power to the sheet feeder 14, the transfer unit 28, the controller 36, the electrifiers 42, the development devices 44, a drive motor 67 that is described later, and others.

The four toner cartridges 50 are connected to the rear side of the photoreceptor unit 26. The toner cartridges 50 are used for the colors of magenta, yellow, cyan, and black, respectively, and each of the toner cartridges 50 is configured by integrating a toner container 52 and a toner recovery unit 54. Each toner container 52 is provided with an agitator 60 as a stirring and conveying member to stir and convey the toner in the relevant toner container 52. Each toner recovery unit 54 is connected to the relevant cleaner 48 and designed so as to recover the waste toner of each of the four colors.

Toner supply mechanisms 62 as toner supply devices are disposed in the image forming apparatus main body 12 and each of the toner supply mechanisms 62 connects the toner container 52 in the relevant toner cartridge 50 to the relevant development device 44. A toner supply auger 64 is rotatably attached to each of the toner supply mechanisms 62 so that, by the rotation of the toner supply auger 64, the toner discharged from the toner container 52 in the relevant toner cartridge 50 may be supplied to the relevant development device 44. In each of the toner supply mechanisms 62, initial toner that is the toner already contained at the time of the shipment of an image forming apparatus 10 is contained and each toner supply mechanism 62 is used as a toner container to contain the initial toner.

An optical writing unit 56 includes a laser exposure device, is placed on the rear side of the photoreceptor unit 26 at a position corresponding to each of the photoreceptors 40, and is designed so as to form a latent image by irradiating a uniformly electrified photoreceptor 40 with laser.

The transfer unit 28 is placed in the vertical direction opposite the photoreceptor unit 26 on the front side of the photoreceptor unit 26. In the transfer unit 28, a transfer belt 66 is put around two support rollers 58 disposed on the upper and lower portions. Further, a transfer roller 68 is placed opposite each of the photoreceptors 40 in the manner of interposing the transfer belt 66.

The fixing device 30 is disposed above the photoreceptor unit 26 and designed so as to fix on a sheet a toner image that is formed with each of the photoreceptors 40 in the photoreceptor unit 26 and transferred on the sheet.

The drive motor 67 is disposed in the image forming apparatus main body 12 and designed so as to drive the photoreceptors 40, the development devices 44, the toner supply mechanisms 62, and others through a drive transmission device (not shown in the figures).

A user interface (UI) 69 is disposed integrally with the image forming apparatus main body 12 or through a network and designed so as to be able to select the processing of the image forming apparatus 10 by operating the UI 69. The UI 69 is provided with a display panel 69*a* to display the contents of the processing of the image forming apparatus 10 and plural manual operation buttons.

The controller 36 is disposed in the image forming apparatus main body 12 and electrically connected to the drive motor 67, the UI 69, a receiver 84 that is described later, and others.

As a result of the above measures, each photoreceptor 40 is uniformly electrified with the relevant electrifier 42, a latent image is formed with the relevant optical writing unit 56, and the latent image is visualized with toner in the relevant development device 44. The toner image formed on each photoreceptor 40 is transferred on a conveyed sheet with the transfer rollers 68 of the transfer unit 28 sequentially from the lower side, and fixed on the sheet with the fixing device 30.

Successively, the photoreceptor unit 26 is explained in detail with reference to FIG. 2. As shown in FIG. 2, the photoreceptor unit 26 is provided with the photoreceptor unit main body 38 as stated earlier and the interior of the photoreceptor unit main body 38 is divided into, for example, the development device 44, the cleaner 48, both explained earlier, and others.

The development device 44 is provided with a toner supply section 38*a* and a development roller 70 is disposed in the vicinity of the photoreceptor 40 in the toner supply section 38*a*. A first stirring and conveying auger 72 and a second stirring and conveying auger 74 are disposed at positions lower than the development roller 70 along the axis of the development roller 70 and rotatably supported respectively by the peripheral wall of the toner supply section 38*a*. The structure is designed so that, when the first stirring and conveying auger 72 and the second stirring and conveying auger 74 rotate respectively, the toner contained in the toner supply section 38*a* may be conveyed toward the development roller 70 while being stirred. Initial toner that is the toner already contained at the time of the shipment of the image forming apparatus 10 is contained in the toner supply section 38*a*, and the toner supply section 38*a* is used as the toner container to contain the initial toner.

The cleaner 48 is provided with a cleaning blade 76 and a waste toner container 38*b*. The structure is designed so that the cleaning blade 76 may scrape off and remove residual toner attached on the surface of the photoreceptor 40 and the waste toner container 38*b* may contain the waste toner removed with the cleaning blade 76. The waste toner container 38*b* has an opening 38*c* to communicate with the toner recovery section 54 of the toner cartridge 50 and waste toner augers 78*a* and 78*b* to convey the waste toner to the opening 38*c* are disposed in the waste toner container 38*b*.

A first memory 80 is disposed on the photoreceptor unit main body 38 and stores parameters such as an ID, a production date, and others on the photoreceptor unit 26. Further, a second memory 82 is disposed at each of the toner cartridges 50 and stores parameters such as an ID, a production date, and others on the relevant toner cartridge 50. Furthermore, a receiver 84 is disposed on the image forming apparatus main body 12 and electrically connected to the first memory 80 and the second memories 82 by a wired or wireless manner. The receiver 84 is designed so as to communicate with the first memory 80 when the photoreceptor unit 38 is attached to the image forming apparatus main body 12 and the second memory 82 when the relevant toner cartridge 50 is attached to the image forming apparatus main body 12.

Figure 3:
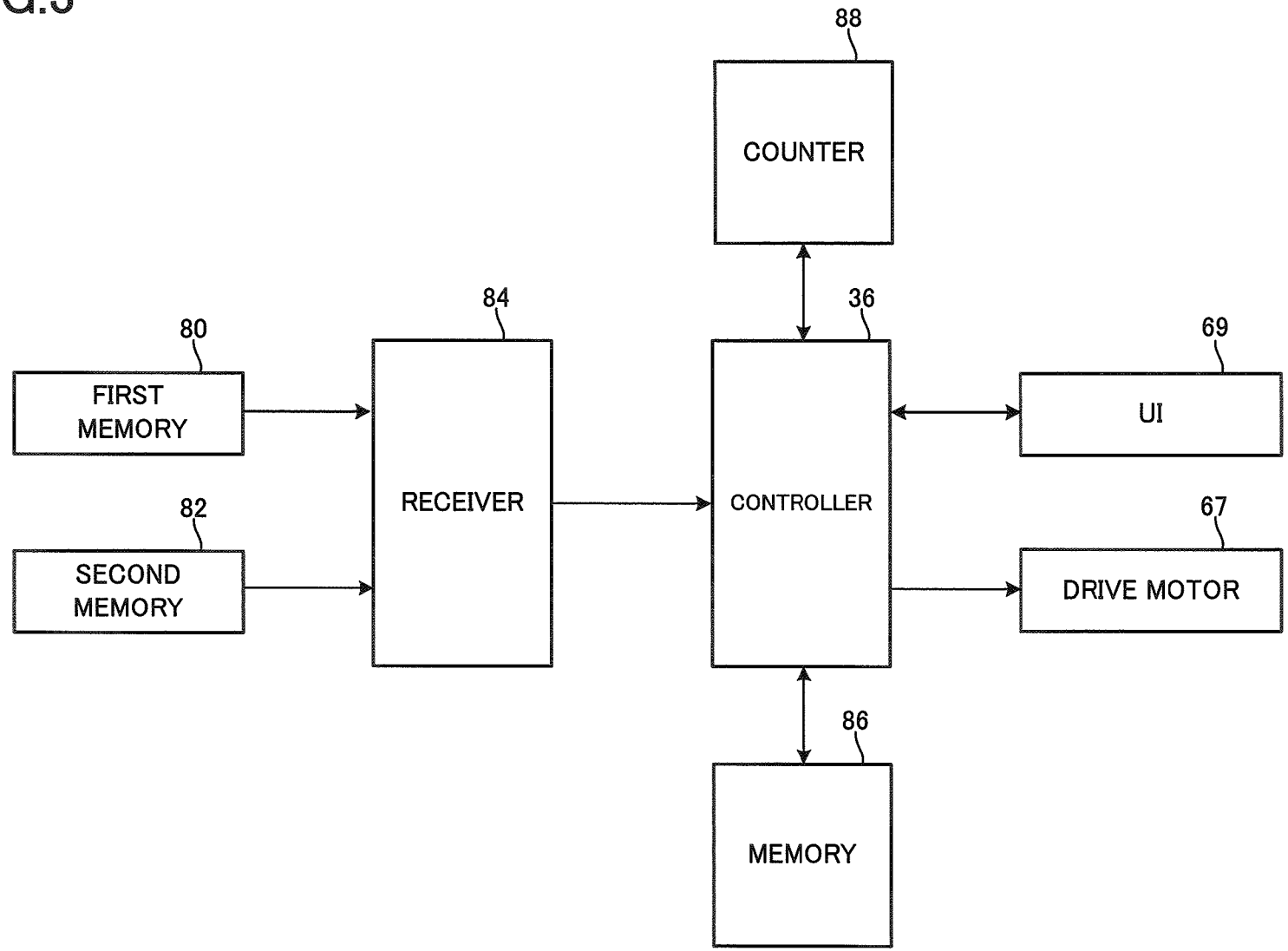
FIG. 3 is a block diagram showing the functional structure of a controller according to an exemplary embodiment of the present invention.

The functional structure of the controller 36 is shown in FIG. 3.

As shown in FIG. 3, the controller 36 is connected to the receiver 84, a memory 86, a counter 88, the UI 69, and the drive motor 67. Further, the receiver 84 is connected to the first memory 80 and the second memory 82.

The receiver 84 is designed so as to transmit the contents of communications between the receiver 84 and the first memory 80 to the controller 36, or the contents of communications between the receiver 84 and the second memory 82 to the controller 36. The memory 86 stores data output from the receiver 84, the counter 88, and the UI 69 into the controller 36. The counter 88 (shown also in FIG. 1) is disposed on the image forming apparatus main body 12 and designed so as to count the number of printed sheets with an optical sensor or the like. The controller 36 is designed so as to control the displayed contents on the display 69*a* of the UI 69 and the operation of the drive motor 67 on the basis of the output signals output from the receiver 84, the memory 86, the counter 88, the UI 69, and others.

Figure 4:
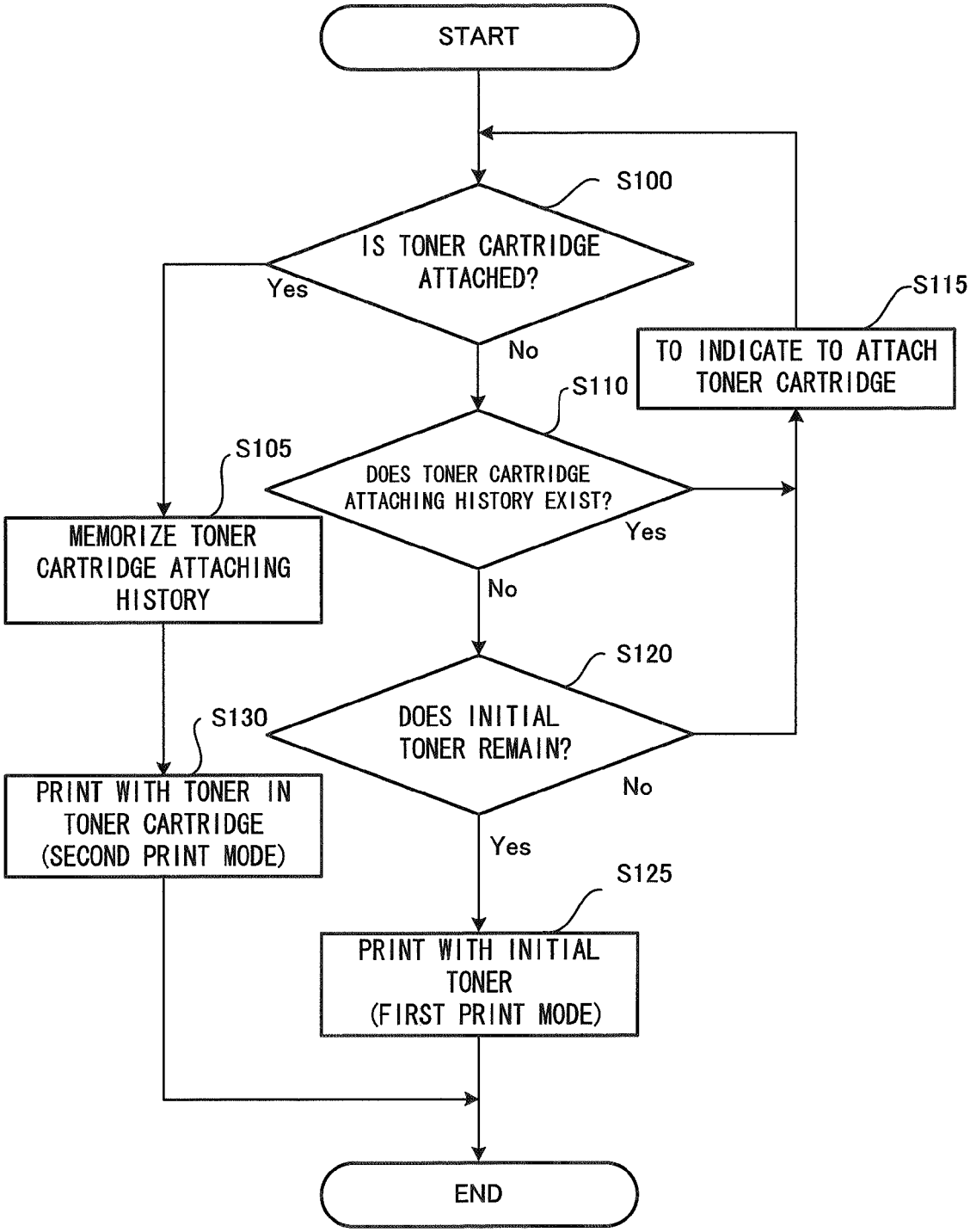
FIG. 4 is a flowchart showing print mode selection processing that is carried out by the controller according to an exemplary embodiment of the present invention.

Print mode selection processing S10 carried out with the controller 36 according to the present exemplary embodiment is shown in FIG. 4.

At Step S100, the controller 36 judges whether or not a toner cartridge 50 is attached to the image forming apparatus main body 12. That is, the controller 36 judges whether or not the second memory 82 disposed on the toner cartridge 50 and the receiver 84 are in a communicable state, and the process goes to the processing of Step S105 when the controller 36 judges that the toner cartridge 50 is attached to the image forming apparatus main body 12, and to the processing of Step S110 when the controller 36 judges that the toner cartridge 50 is not attached to the image forming apparatus main body 12.

At Step S105, the controller 36 makes the memory 86 store the history of the attachment of the toner cartridge 50 to the image forming apparatus main body 12.

At Step S110, the controller 36 judges the existence or nonexistence of the history of the attachment of the toner cartridge 50 to the image forming apparatus main body 12. That is, the controller 36 judges whether or not the history of the attachment of the toner cartridge 50 to the image forming apparatus main body 12 is stored in the memory 86, and the process goes to the processing of Step S115 when the controller 36 judges that the history of the attachment of the toner cartridge 50 to the image forming apparatus main body 12 exists, and to the processing of Step S120 when the controller 36 judges that the history of the attachment of the toner cartridge 50 to the image forming apparatus main body 12 does not exist.

At Step S115, the controller 36 instructs to attach a toner cartridge on the display 69*a* of the UI 69 and the process goes back to the processing of Step S100.

At Step S120, the controller 36 judges the amount of the remaining initial toner in the toner supply section 38*a* of a development device 44 and the toner supply mechanism 62. That is, the controller 36 judges the amount of the remaining initial toner in the toner supply section 38*a* of a development device 44 and the toner supply mechanism 62 on the basis of the output signals output from the counter 88, and the process goes to the processing of Step 125 when the controller 36 judges that the initial toner exists, and to the processing of Step S115 when the controller 36 judges that the initial toner does not exist. Here, it is also possible to judge the amount of the remaining initial toner using a value detected with a concentration detecting sensor (not shown in the figure), a toner remaining amount detecting sensor (not shown in the figure) in a development device 44, or the like.

At Step S125, the controller 36 activates the drive motor 67 and carries out printing with the initial toner contained in the toner supply section 38*a* of a development device 44 or the toner supply mechanism 62 (the first print mode). At the time, the waste toner removed from the surface of the photoreceptor 40 is contained in the waste toner container 38*b*.

At Step S130, the controller 36 activates the drive motor 67 and carries out printing with the toner in the toner container 52 of the toner cartridge 50 (the second print mode). At the time, the waste toner removed from the surface of the photoreceptor 40 is temporarily contained in the waste toner container 38*b* and conveyed to the toner recovery unit 54 of the toner cartridge 50 through the waste toner augers 78*a* and 78*b*. Here, the waste toner contained in the waste toner container 38*b* at the time of the aforementioned first print mode (Step S125) is conveyed to the toner recovery unit 54 of the toner cartridge 50 when the toner cartridge 50 is attached.

As explained above, the controller 36 controls printing by switching between the first print mode wherein printing is carried out in the state where the toner cartridge 50 is not attached to the image forming apparatus main body 12 and the second print mode wherein printing is carried out in the state where the toner cartridge 50 is attached to the image forming apparatus main body 12. As a result, in the case of the first print mode, since printing is carried out with the initial toner contained in the toner supply section 38*a* of a development device 44 or the toner supply mechanism 62, it is possible to print a prescribed number of copies even when the toner cartridge 50 is not attached to the image forming apparatus main body 12. By so doing, a user can select whether or not the user purchases a toner cartridge when the user purchases an image forming apparatus and thus the purchase price of the image forming apparatus can be reduced.

Further, the controller 36 controls printing so as to carry out the second print mode wherein printing is carried out with toner in the toner cartridge 50 only after the toner cartridge 50 is attached to the image forming apparatus main body 12. By so doing, even when the toner cartridge 50 attached to the image forming apparatus main body 12 is wrongly detached, the indication to attach a toner cartridge can be displayed and wrong operation can be prevented.

Here, the controller 36 is designed so as to carry out the aforementioned print mode selection processing S10 for each of toner cartridges 50. For example, it is also possible to design the controller 36 so as to attach only the toner cartridge 50 of black-color as a specific color to the image forming apparatus main body 12, carry out only the second print mode wherein the printing is carried out with toner in the toner cartridge 50 in the case of black-and-white printing, and carry out the first print mode wherein the printing is carried out with the initial toners contained in the toner supply sections 38*a* of the development devices 44 or the toner supply mechanisms 62 in the case of the printing of the other colors such as magenta, yellow, and cyan. By so doing, a user who does not want color printing can use an image forming apparatus according to the present exemplary embodiment as an image forming apparatus for black-and-white printing without attaching the toner cartridges of magenta, yellow and cyan colors.

As stated above, the present invention can be used for an image forming apparatus that is required to reduce the purchase price.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus, comprising:

an image forming apparatus main body;

a development device that develops a latent image formed in an image retainer with toner;

a toner cartridge that is detachably attached to the image forming apparatus main body and contains toner supplied to the development device; and a controller that controls printing in a first print mode when printing is carried out with initial toner contained in the apparatus in a state where no toner cartridge is attached to the image forming apparatus main body.

2. The image forming apparatus according to claim 1, wherein the controller switches and controls the first print mode when printing is carried out in a state where no toner cartridge is attached to the image forming apparatus main body and a second print mode when printing is carried out in a state where the toner cartridge is attached to the image forming apparatus main body.

3. The image forming apparatus according to claim 2, wherein the controller controls the printing so as to carry out only the second print mode when the toner cartridge is attached to the image forming apparatus main body.

4. The image forming apparatus according to claim 2, wherein the image forming apparatus is provided with the toner container that contains toners of a plurality of colors; and the controller uses toner of a specific color in the first print mode and toners of other colors in the second print mode.

5. The image forming apparatus according to claim 1, wherein at least one of the image forming apparatus main body and the development device is provided with a toner container that contains toner.

6. The image forming apparatus according to claim 5, further comprising a toner supply unit that is disposed on the image forming apparatus main body and supplies toner to the development device, wherein the toner container is the toner supply unit.

7. The image forming apparatus according to claim 1, wherein at least one of the image forming apparatus main body and the development device is provided with a waste toner container that contains waste toner removed from the image retainer.

8. The image forming apparatus according to claim 1, the apparatus carries out printing a predetermined number of copies with the initial toner in the first printing mode when no cartridge is attached to the main body.

9. An image forming apparatus including an image forming apparatus main body to which a toner cartridge containing toner is attachable, the apparatus comprising:

an image writing device which writes a latent image on an image retainer;

a development device which develops the latent image with toner; and a controller which controls printing to be carried out with toner contained in the apparatus when no toner cartridge is attached to the main body.

10. The image forming apparatus according to claim 9, wherein the toner contained in the apparatus is initial toner that is contained in the apparatus at the time of the shipment of the apparatus.

11. The image forming apparatus according to claim 9, wherein the controller controls printing to be carried out with toner of the toner cartridge when the toner cartridge is attached to the main body.

12. The image forming apparatus according to claim 9, wherein the development device includes the toner contained in the apparatus.

13. The image forming apparatus according to claim 9, further comprising a toner supply unit which connects the toner cartridge to the development device and includes the toner contained in the apparatus.

14. An image forming method in an image forming apparatus including an image forming apparatus main body to which a toner cartridge containing toner is attachable, the method comprising:

judging whether any toner cartridge is attached to the main body;

performing printing with toner of a toner cartridge if it is judged that a toner cartridge is attached to the main body; and performing printing with toner contained in the apparatus if it is judged that no toner cartridge is attached to the main body.

15. The image forming method according to claim 14, wherein the toner contained in the apparatus is initial toner that is contained in the apparatus at the time of shipment of the apparatus.

* * * * *